United States Patent [19]

Sakuma

[11] Patent Number: 4,747,087

[45] Date of Patent: May 24, 1988

[54] ALARM CLOCK

[75] Inventor: Shoichi Sakuma, Tokyo, Japan

[73] Assignee: Seikosha Co., Ltd., Tokyo, Japan

[21] Appl. No.: 2,855

[22] Filed: Jan. 13, 1987

[30] Foreign Application Priority Data

Jan. 20, 1986 [JP] Japan ..... 61-5994[U]

[51] Int. Cl.[4] ..... G04B 23/00

[52] U.S. Cl. ..... 368/262; 368/267

[58] Field of Search ..... 368/362, 367, 72

[56] References Cited.

U.S. PATENT DOCUMENTS

| | | | |
|---|---|---|---|
| 1,381,225 | 6/1921 | Pfeifer | 368/262 |
| 3,192,699 | 7/1965 | Stout | 368/262 |

FOREIGN PATENT DOCUMENTS

| | | | |
|---|---|---|---|
| 1356163 | 2/1964 | France | 368/262 |
| 933903 | 8/1963 | United Kingdom | 368/262 |
| 2122775 | 1/1984 | United Kingdom | 368/262 |

*Primary Examiner*—Bernard Roskoski

*Attorney, Agent, or Firm*—Bruce L. Adams; Van C. Wilks

[57] ABSTRACT

An alarm clock is provided having a handle resembling a rainbow while the clock case resembles a cloud. The handle of the alarm clock is pivotally attached to the clock case of the alarm clock at one end thereof. The other end of the handle is physically connected to an on/off lever of the alarm mechanism in such a manner as to be vertically movable in response to pivotal movement of the handle. An interlocking mechanism is provided to convert the pivotal movement of the handle into vertical movement of the on/off lever. The interlocking mechanism comprises a guide protrusion or operating button forming part of said handle and recessed portions within the guide protrusion. The recessed portions interact with projections on the on/off lever, the on/off lever having spring pieces at the other end thereof and the spring pieces being actuated by positioning pins.

9 Claims, 3 Drawing Sheets

ALARM CLOCK

BACKGROUND OF THE INVENTION

The present invention relates to an alarm clock, and more particularly, to an alarm clock having a handle.

In a conventional alarm clock equipped with a handle, an alarm ON/OFF button is provided on an upper surface of a case of the clock and is at the same time disposed just beneath the handle, or this kind of button is provided on the rear surface of the case.

In the above-described examples of the prior art alarm clock, when stopping the alarming of the clock, the user has to insert his or her finger in a space formed between the handle and the upper surface of the case and to push down the alarm ON/OFF button, this coducing to undesirable operativity. On the other hand, where the alarm ON/OFF button is provided on the rear surface of the case, when manipulating the button, the clock must be turned back, which also leads to unfavorable operativity.

Accordingly, it is a primary object of the present invention to provide an alarm clock which is capable of facilitating an alarm-off operation and has such an advantage that costs of production can be reduced by the simplifying thereof.

An alarm clock according to the present invention is characterized in that: one end portion of a handle is swayably attached to a case thereof; the other end portion of the handle and an alarm ON/OFF lever is so fitted to the movement as to be vertically movable and are linked to each other by means of an interlocking mechanism which comprises a projection formed on either said lever or said handle and a recessed portion for receiving said projection formed in the other; and the alarm ON/OFF lever is made to move up and down by swinging the handle.

By a simple operation of swinging the handle, the alarm ON/OFF lever vertically moves such as to be concomitant with the swinging, thereby stopping the alarming and releasing this stopping state. No special member is employed, and a simple constitution suffices, whereby costs of production are decreased.

BRIEF DESCRIPTION OF THE DRAWINGS

The Figures in combination show one embodiment of the present invention.

DESCRIPTION OF THE PREFERRED EMBODIMENT

Figure 1:
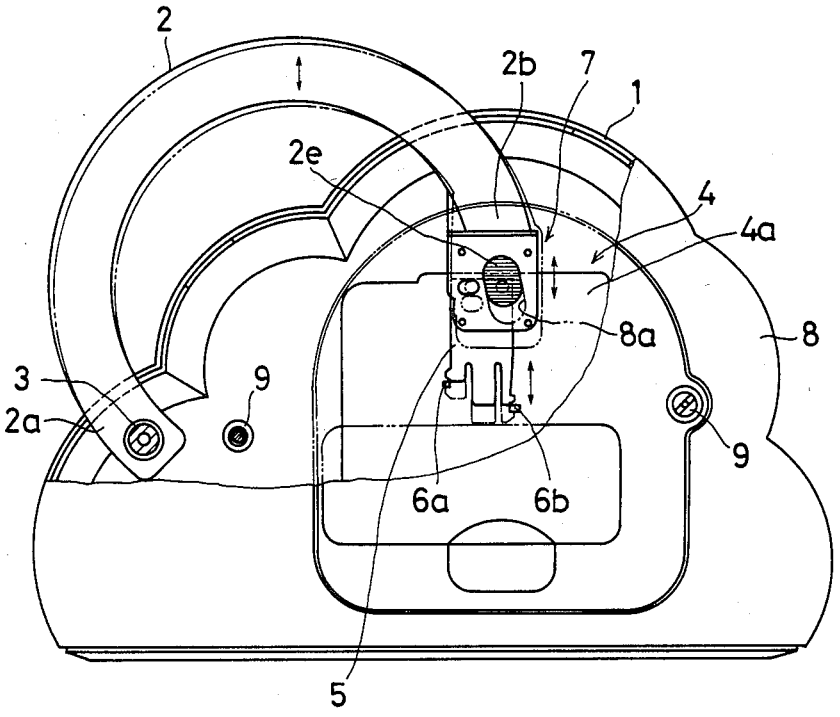
FIG. 1 is a rear side elevation of an alarm clock with parts partially broken away.
Figure 2:
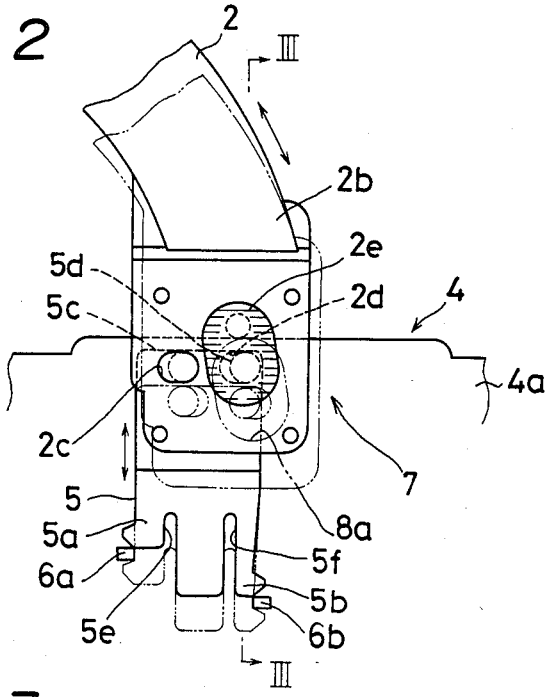
FIG. 2 is an expanded front view of the principal portion thereof.
Figure 3:
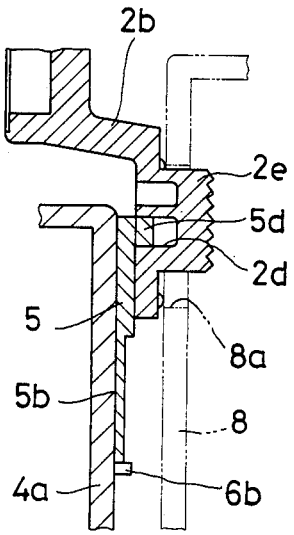
FIG. 3 is a sectional view taken substantially along the line III—III of FIG. 2.
Figure 4:
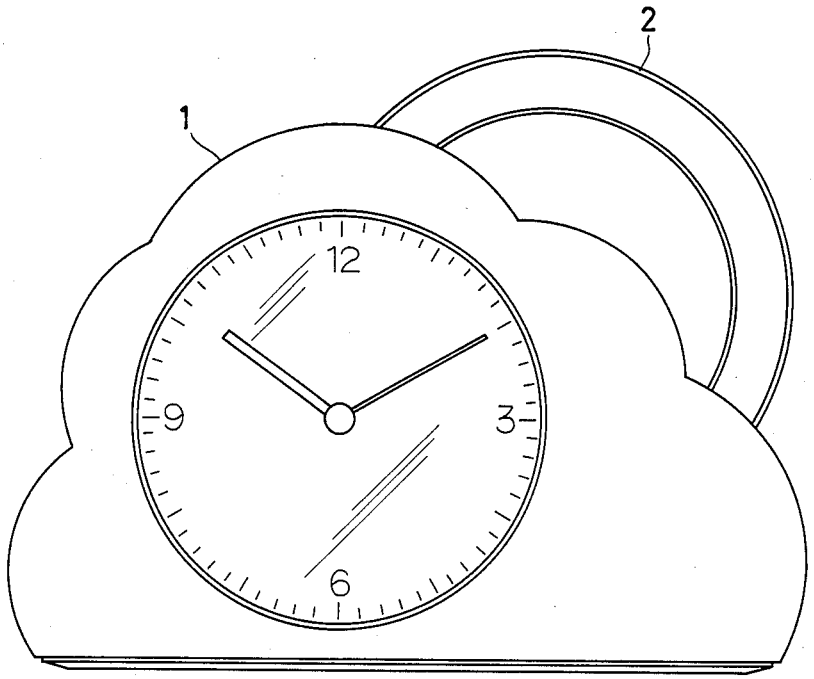
FIG. 4 is a front view of the alarm clock.

The Figures in combination show one embodiment of the present invention. It can be observed from FIG. 4 that an outer configuration of a front case 1 bears some resemblance to a cloud, and a rainbow-like handle 2 is protruded from a part of the front case 1. As illustrated in FIG. 1, the handle 2 subsumes one end portion 2*a* which is swayably or pivotably supported by a bushing 3 whose front end is arranged to form a bearing surface in the front case 1. A movement 4 is secured to the rear surface of the front case 1, and an alarm ON/OFF lever 5 is fitted to the rear surface of a movement cover 4*a* so that the alarming can be stopped and the stopped state can also be released by vertical movement of the lever. As illustrated in FIG. 2, the lower end of the alarm ON/OFF lever 5 is formed with notched grooves 5*e*, 5*f*. With this arrangement, spring pieces 5*a*, 5*b* each having a pawl at its tip are shaped on both sides of the alarm ON/OFF lever 5. Positioning pins 6*a*, 6*b* are protruded from the movement cover 4*a*; and ascent and descent positions of the alarm ON/OFF lever 5 are determined by a step wherein the pawls provided at the tips of the spring pieces are pushed off over these pins. An interlocking mechanism 7 is provided between the other end portion 2*b* of the handle 2 and the alarm ON/OFF lever 5. Videlicet, as illustrated in FIGS. 2, 3, projections 5*c*, 5*d* are formed on the alarm ON/OFF lever 5. The surface, which stands vis-à-vis with the alarm ON/OFF lever 5, of the handle 2 is formed with recessed portions 2*c*, 2*d* in which the projections 5*c*, 5*d* are fitted. The rear surface of the other end portion 2*b* of the handle 2 is provided with a guide protrusion 2*e* serving as an operating button. The back end of the bushing 3 is arranged to form a bearing surface (not illustrated) in a rear case 8 which is linked through the intermediary of a screw 9 to the front case 1. A movable window 8*a* is formed in the rear case 8 through which the guide protrusion or operating button 2*e* projects.

The position, indicated by a solid line of FIG. 1, of the handle 2 is in a state of actuating the alarm. The other end portion 2*b* of the handle 2 is in the ascent position, and the alarm ON/OFF lever 5 is also in the ascent position through the intermediary of the recessed portions 2*c*, 2*d* and the projections 5*c*, 5*d*. The positioning pins 6*a*, 6*b* come in contact with the lower ends of the pawls of the spring pieces 5*a*, 5*b* to set their positions. On the occassion of stopping a sound of the alarm, upon a push downward of the handle 2, the handle 2 pivots round the bushing 3 of the one end portion 2*a* thereof, whereby the other end portion 2*b* descends. Thereupon, as shown in FIGS. 2, 3, the alarm ON/OFF lever 5 is lowered through the interaction of recessed portions 2*c*, 2*d* and the projections 5*c*, 5*d*, at which time the spring pieces 5*a*, 5*b* are deflected inwards, the pawls are pushed off over the positioning pins 6*a*, 6*b*, and the above-described lever is thus set in the descent position, thereby stopping the alarming of the clock. The guide protrusion or operating button 2*e* is lowered while moving within the window 8*a*. It is to be noted that it is practicable to operate the guide protrusion 2*e* as the alarm ON/OFF button. It is not, however, necessarily required to provide this member.

When slightly raising the handle 2, the alarm clock body is not lifted due to its own weight. As a result, ascending forces act on the alarm ON/OFF lever and the spring pieces 5*a*, 5*b* are thereby deflected to such an extent that they are pushed off over the positioning pins 6*a*, 6*b*. The alarm ON/OFF lever 5 reverts to the original ascent position, thereby releasing the stopped state thereof.

An alarm clock having the above-described constitution according to the present invention yields the following effects. It is feasible to stop the alarming of the clock or to release the stopped state simply by pushing the handle or raising it. Hence, the operatively is highly favorable. Since the interlocking mechanism is essentially composed by the projections and the recessed portions, the configuration is extremely simple. The costs of production are therefore decreased.

I claim:

1. An alarm clock comprising: a clock case containing a clock movement; a pivotable handle having one end thereof pivotably mounted on the clock case; an alarm on/off lever mounted to undergo vertical movement with respect to the clock case to thereby activate and deactivate an alarm; and an interlocking mechanism for effecting vertical movement of the alarm on/off lever in response to pivotal movement of the handle, the interlocking mechanism having means connecting the handle to the alarm on/off lever at all positions of the alarm on/off lever and comprising a projection formed on either the alarm on/off lever of the handle, and a recessed portion formed in the other of the alarm on/off lever or the handle and coacting with the projection to convert the pivotal movement of the handle into vertical movement of the alarm on/off lever.

2. The alarm clock of claim 1; including a guide protrusion mounted to undergo back-and-forth movement within a movable window in accordance with the pivotal movement of the handle.

3. The alarm clock of claim 1; wherein the alarm on/off lever has at one end thereof grooves of unequal lengths to define spring pieces of the alarm on/off level; and positioning pins stationarily positioned relative to the alarm on/off lever and engageable with respective ones of the spring pieces to determine the ascent and descent positions of the alarm on/off lever.

4. The alarm clock of claim 1; including a bushing mounted in the clock case for pivotably supporting the handle.

5. The alarm clock of claim 1; wherein the clock case has a shape resembling a cloud, and the handle has a shape resembling a rainbow.

6. The alarm clock of claim 1; including means for alternately initiating and stopping the alarm in response to alternate vertical movements of the alarm on/off lever.

7. The alarm clock of claim 1; wherein the end of the alarm on/off lever that is not connected to the handle is fitted with spring pieces each having a pawl at its tip, the pawls projecting outwardly from the sides of the alarm on/off lever.

8. The alarm clock of claim 1; including pawls provided at the tips of spring piece portions of the alarm on/off lever and coacting with stationary positioning pins for controlling the ascent and descent positions of the alarm on/off lever.

9. The alarm clock of claim 1; wherein a guide protrusion portion of said pivotable handle projects through a movable window formed in a rear case of said clock.

* * * * *